US006974509B2

(12) United States Patent
Hagiwara et al.

(10) Patent No.: US 6,974,509 B2
(45) **Date of Patent: *Dec. 13, 2005**

(54) BRASS

(75) Inventors: Koichi Hagiwara, Nagano (JP); Masaru Yamazaki, Nagano (JP); Yoshihiro Hirata, Nagano (JP); Mitsuhide Hirabayashi, Nagano (JP); Kozo Ito, Nagano (JP)

(73) Assignee: Kitz Corporation, Chiba-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/449,516

(22) Filed: Jun. 2, 2003

(65) Prior Publication Data

US 2003/0205301 A1 Nov. 6, 2003

Related U.S. Application Data

(63) Continuation-in-part of application No. 09/657,227, filed on Sep. 7, 2000, now Pat. No. 6,599,378.

(51) Int. Cl.[7] ..... C22C 9/02
(52) U.S. Cl. ..... 148/433; 420/472
(58) Field of Search ..... 148/433; 420/472

(56) References Cited

U.S. PATENT DOCUMENTS 5,487,867 A * 1/1996 Singh ..... 420/471
5,614,038 A 3/1997 King et al.
5,653,827 A 8/1997 Kramer et al.

FOREIGN PATENT DOCUMENTS

| | | |
|---|---|---|
| JP | 7317804 | 12/1995 |
| JP | 8-120369 | 5/1996 |
| JP | 9316570 | 12/1997 |
| JP | 2000169919 | * 6/2000 |

OTHER PUBLICATIONS

Hansen, Max, Constitution of Binary Alloys, 2nd Edition, McGraw–hill Book Company, Inc., New York, 1958, pp. 648–655.

* cited by examiner

*Primary Examiner*—Sikyin Ip
(74) *Attorney, Agent, or Firm*—Wenderoth, Lind & Ponack, L.L.P.

(57) ABSTRACT

Brass consists essentially of Cu, Sn, Bi, Fe, Ni and P in weight ratios respectively of 58.0–63.2%, 0.3–2.0%, 0.7–2.5%, 0.05–0.3%, 0.10–0.50% and 0.05–0.15% plus the balance of Zn and unavoidable impurities to exhibit excellent tolerance for dezincification, hot forgeability and machinability.

2 Claims, 8 Drawing Sheets

(7 of 8 Drawing Sheet(s) Filed in Color)

(×400)

(×400)

BRASS

REFERENCE TO COPENDING APPLICATION

This is a continuation-in-part application of U.S. patent application Ser. No. 09/657,227 filed Sep. 7, 2000, now U.S. Pat. No. 6,599,378.

BACKGROUND OF THE INVENTION

1. Field of the Invention

This invention relates to a copper-based alloy which permits elimination or reduction of defilement with lead and excels in tolerance for dezincification, hot forgeability, or machinability, a method for the production of this alloy, and products using this alloy.

2. Description of the Prior Art

Generally in the copper-based alloys of this class, Cu—Zn brass alloys and Cu—Sn bronze alloys each having Cu as a main component are being used extensively.

Particularly, the brass alloys have been finding extensive dissemination because they are excellent in corrosion resistance, workability, forgeability, and mechanical properties and are also favorable in terms of price as compared with other copper-based alloys.

The brass alloys are known in various types, such as free cutting brass (C3604 of JIS [Japanese Industrial Standard] H3250), forging grade brass (JIS C3771) and brass (BS [British Standard] CZ132).

Particularly, the free cutting brass bar has a high Pb content of 1.8–3.7%. When it is used in a metallic part, such as the valve that by nature operates in water, it encounters difficulty in satisfying the condition of the standard tolerance for Pb liquation (not more than 0.05 mg/liter, for example) because it liquates the Pb out into the water. The problem posed by such lead liquation, therefore, needs a prompt solution.

The free cutting brass bar is a brass material which has the $\alpha+\beta$ phase for the texture thereof and, in relative ratios, contains Cu predominantly in the $\alpha$ phase and Zn likewise in the $\beta$ phase. When this brass bar is retained in the atmosphere of a corrosive liquid, therefore, it forms a local cell from the potential difference between the $\alpha$ phase and the $\beta$ phase and induces liquation of Zn and corrosion by dezincification.

Then, the ordinary forging grade brass bar combines the problem of liquation of Pb and the problem of corrosion by dezincification similarly to the free cutting brass bar.

As a measure against the problem of environment pollution due to this liquation of lead, the technique of producing blue brass incorporating Bi singly or Se and Bi jointly into a copper-based alloy in place of Pb with a view to eliminating the influence of the lead has been already suggested (U.S. Pat. No. 5,614,038).

Further, the technique of perfecting bronze by adding P to the technique for combating the lead as described above thereby forming an intermetallic compound, $Cu_3P$, and enhancing the wear resistance thereof has been known (JP-A-08-120369). Various other techniques for combating lead have been suggested.

The conventional copper-based alloy materials have originated in the lead-combating technique that is directed at copper-based alloys. No technique that additionally excels in tolerance for dezincifiction as well as in machinability and forgeability has yet been known. No copper-based alloy that has solved a further particular problem of the tolerance for corrosion by dezincification peculiar to brass has yet been developed. Such is the true state of the conventional copper-based alloys.

This invention has been perfected as a result of a diligent study pursued with a view to solving the problems of the prior art. It is directed at clearing the problem of environmental pollution by the liquation of lead and, at the same time, providing a copper-based alloy of brass or bronze excelling in tolerance for dezincification, machinability, and hot forgeability.

SUMMARY OF THE INVENTION

The present invention provides brass consisting essentially of Cu, Sn, Bi, Fe, Ni and P in weight ratios respectively of 58.0–63.2%, 0.3–2.0%, 0.7–2.5%, 0.05–0.3%, 0.10–0.50% and 0.05–0.15% plus the balance of Zn and unavoidable impurities to exhibit excellent tolerance for dezincification, hot forgeability and machinability.

The brass can further consist of Se in a weight ratio of 0.03–0.25%.

The brass can be a hot forging grade brass consisting of Cu, Sn, Bi, Fe, Ni and P in weight ratios respectively of 59.0–62.0%, 0.5–1.5%, 1.0–2.0%, 0.05–0.20%, 0.10–0.30 and 0.05–0.10% plus Se in a weight ratio of 0.03–0.20%.

The brass can be a hot forging grade brass consisting of Cu, Sn, Bi, Fe, Ni and P in weight ratios respectively of 59.0–62.0%, 0.5–1.5%, 1.0–2.0%, 0.05–0.20%, 0.10–0.30 and 0.05–0.10% plus Se in a weight ratio of 0.03–0.20%.

The brass can be a machining grade brass consisting of Cu, Sn, Bi, Fe, Ni and P in weight ratios respectively of 61.0–63.0%, 0.3–0.7%, 1.5–2.5%, 0.1–0.30%, 0.10–0.30 and 0.05–0.10% plus Se in a weight ratio of 0.03–0.20%.

The brass can be a machining grade brass consisting of Cu, Sn, Bi, Fe, Ni and P in weight ratios respectively of 61.0–63.0%, 0.3–0.7%, 1.5–2.5%, 0.1–0.30%, 0.10–0.30% and 0.05–0.10% plus Se in a weight ratio of 0.03–0.20%.

BRIEF DESCRIPTION OF THE DRAWINGS

The patent or anolication file contains at least one drawing executed in color. Copies of this patent or patent application publication with color drawing(s) will be provided by the Office upon request and payment of the necessary fee.

FIG. 6(*b*) is a photograph showing the surface of the sample cut off by a depth of 1.5 mm from the skin surface.

FIG. 6(*c*) is a photograph showing the partially enlarged portion of the cut surface shown in FIG. 6(*b*).

FIG. 6(*d*) is a photograph showing the cross section of the continuously cast sample of FIG. 6(*a*).

FIG. 7(*b*) is a photograph showing the surface of the sample cut off by a depth of 1.5 mm from the skin surface.

FIG. 7(*c*) is a photograph showing the cross section of the continuously cast sample of FIG. 7(*a*).

FIG. 8(*b*) is a photograph showing the surface of the sample cut off by a depth of 1.5 mm from the skin surface.

FIG. 8(*c*) is a photograph showing the cross section of the continuously cast sample of FIG. 8(*a*).

DESCRIPTION OF THE PREFERRED EMBODIMENTS

Figure 1:
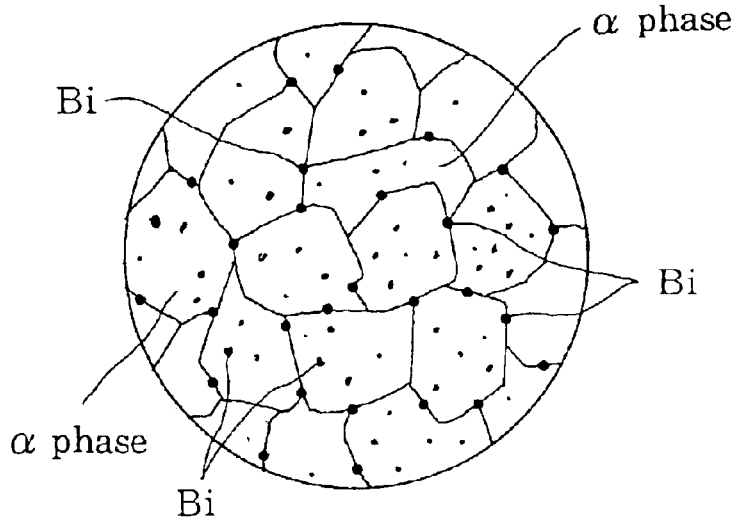
FIG. 1 is a schematic diagram of texture illustrating one example of this invention, with a base phase finely divided.
Figure 2:
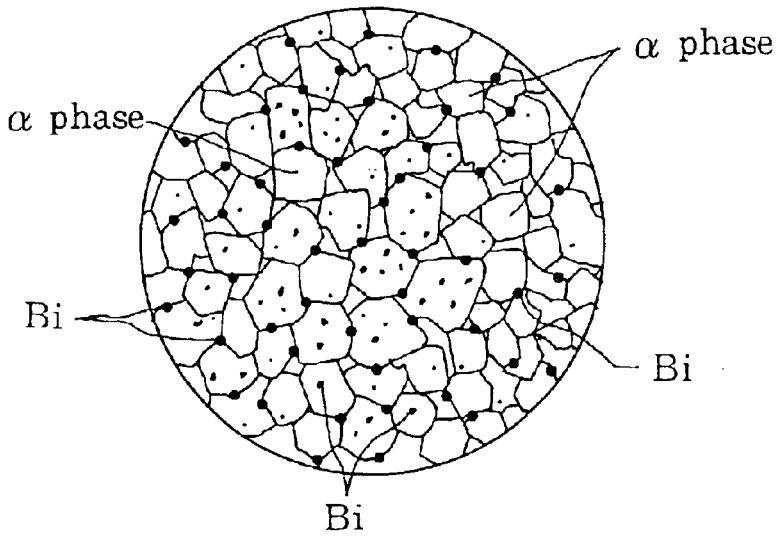
FIG. 2 is a schematic diagram of texture illustrating another example of this invention, with the base phase more finely divided to allow separated Bi to be uniformly dispersed.

This invention concerns a copper-based alloy which has the machinability thereof enhanced by dispersing the hard phase and the soft phase by the use of at least one additive selected from among Bi, Se, Fe, B, etc.

In this case, the metallic crystals of the alloy have the intermetallic compounds, Zn+Se and Cu+Se (arising from the incorporation of Bi and Se) and $CU_3P$ and $Fe_3Sn$ (arising from the incorporation of P and Fe), deposited in a dispersed state besides the base phase formed of the α phase, the α+β phase, or the α+β+γ phase. These intermetallic compounds and the γ phase form the hard phase which is hard and friable, and the soft phase formed of Bi, etc. is uniformly dispersed by the precipitation of the intermetallic compounds.

By incorporating additives, such as Bi, Se, Fe, B, etc., therefore, it is made possible to disperse the hard phase and soft phase uniformly and improve the alloy in machinability and in the condition of finished surface.

The dispersion of the soft phase and hard phase involved in the invention is rated as shown in Table 1.

TABLE 1

| | Phase | | | |
|---|---|---|---|---|
| | Soft phase | | Soft phase + hard phase Bi + Se, Bi + Se + γ phase, | Hard phase |
| Item of rating | Pb | Bi | Bi + γ phase | solely of γ phase |
| Resistance to cutting | ◎ | ◎ | ○ | X |
| State of surface finish | X | Δ | ○ | ○ |

(The data of Table 1 has resulted from rating the alloy for the combination of the soft phase + hard phase on the four-point scale, wherein
○ denotes standard,
◎ denotes a better level by not less than 10%,
X denotes a worse level by not less than 10%, and
Δ denotes a worse level by not less than 5%.)

When the soft phase alone is present, the surface roughness is inferior and the state of finish of the machined surface is unsatisfactory in spite of low resistance to cutting. In contrast, when the hard phase alone is present, the resistance to cutting is high and the machinability is unsatisfactory in spite of a fine state of surface finish.

It has been ascertained that appropriate resistance to cutting and a fine state of surface finish can be obtained by dispersing the soft phase and the hard phase as contemplated by this invention.

This invention further concerns a brass which possesses a composition consisting, in weight ratio, of 58.0–63.2% of Cu, 0.3–2.0% of Sn, and 0.7–2.5% of Bi, and the balance of Zn and inevitable impurities and excels in tolerance for dezincification, hot forgeability, and machinability.

In this case, the alloy is preferred to contain Se in a concentration in the range of 0.03–0.25% by weight.

In the copper-based alloy, the hot forging grade brass contains, in weight ratio, 58.0–62.0% of Cu, 0.5–1.5% of Sn, 1.0–2.0% of Bi, 0.03–0.20% of Se, 0.10–0.50% of Ni, 0.05–0.20% of Fe, and 0.05–0.10% of P.

Then, the machining grade brass comprises, in weight ratio, 61.0–63.0% of Cu, 0.3–0.7% of Sn, 1.5–2.5% of Bi, 0.03–0.20% of Se, 0.10–0.50% of Ni, 0.1–0.30% of Fe, and 0.05–0.10% of P.

Now, the ranges of quantity of the components of the copper-based alloy according to this invention and the reasons for defining these ranges will be described below. The ratios of the components are expressed in wt. %.

Cu: The range of quantity of Cu has been set at 58.0–63.2% in consideration of the fact that although the tolerance for dezincification is improved in accordance as the amount of Cu is increased, the consumption of Cu must be repressed on account of its higher unit price than Zn and with due respect to the purpose of obtaining satisfactory hot forgeability and to the amount of the P which is added with a view to obtaining tolerance for dezincification. Particularly, the range is preferred to be 58.0–62.0% in the case of the hot forging grade brass and to be 61.0–63.0% in the case of the machining grade brass.

Sn: This is added for the purpose of improving the tolerance for dezincification. Since Sn has a higher unit price than Zn, the amount of Sn must be decreased to the fullest possible extent for the purpose of repressing the cost of material. Increasing the amount of Sn to be added results in inducing precipitation of a hard and friable phase of and adding to the resistance to cutting. Notwithstanding this fact, the range of quantity of Sn has been set at 0.3–2.0% in consideration of the tolerance for dezincification which is attained for the amounts of Cu and P to be added. Particularly, the range is preferred to be 0.5–1.5% in the case of the hot forging grade brass and 0.3–0.7% in the case of the machining grade brass.

Bi: This is added for the purpose of improving the machinability. If the Bi content is less than 0.7%, the shortage will be at a disadvantage in greatly affecting the machinability and degrading the machinability. Conversely, if it exceeds 2.5%, the excess will be at a disadvantage in degrading tensile strength, elongation, hot forgeability, and hot workability. Hence, the range of quantity of Bi has been set at 0.7–2.5%. Particularly in the case of the hot forging grade brass, the lower limit of the range has been set at 1.0% because no machinability is obtained when the Bi content is less than 1.0% and the upper limit of the range set at 2.0% in consideration of hot forgeability and hot workability. In the case of the machining grade brass, the range is preferred to be 1.5–2.5%.

Se: This element, when added in a minute amount, improves the alloy in machinability. Though the Se improves the alloy in machinability by forming compounds with Cu and Zn and persisting in the form of such compounds in the alloy, the consumption of this element is repressed to the fullest possible extent because it has a higher unit price than Zn. The range of quantity of Se has been set at 0.03–0.25% in consideration of possible adverse effects on hot forgeability and hot workability. Particularly in the case of the hot forging grade brass or the machining grade brass, the range is preferred to be 0.03–0.20%.

Figure 6:
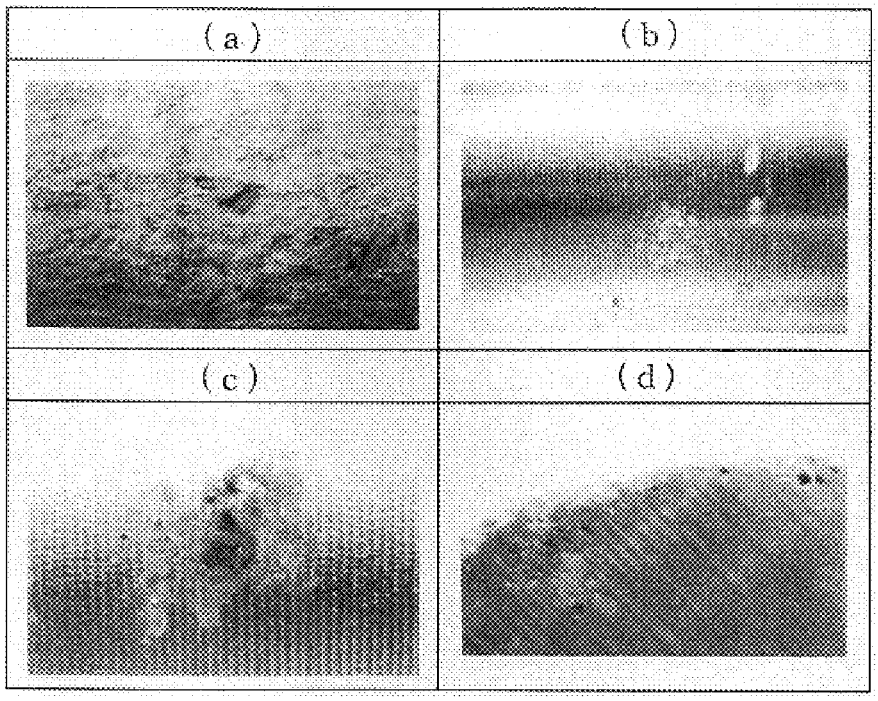
FIG. 6(*a*) is a photograph showing the skin surface of a continuously cast sample containing 0.06% of Ni.
Figure 7:
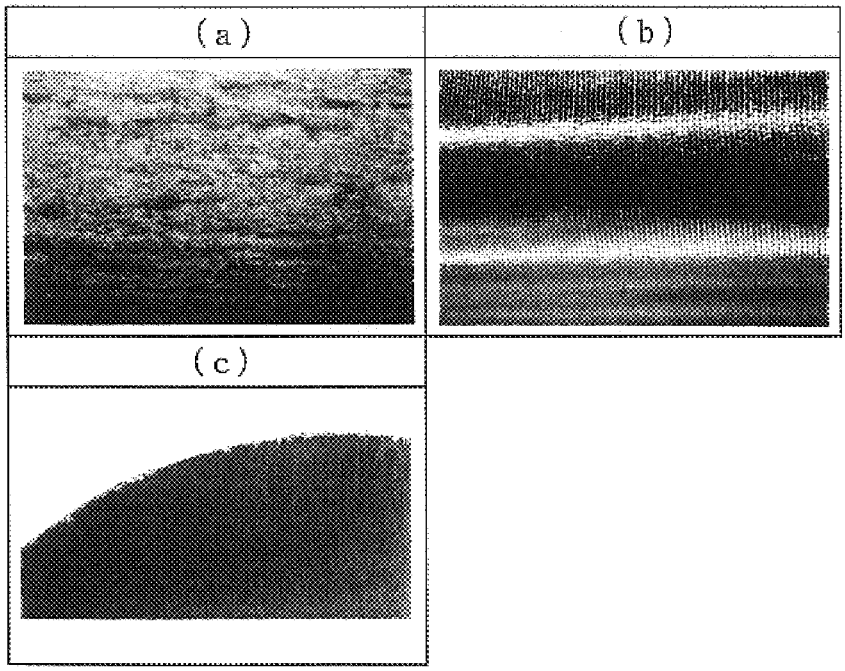
FIG. 7(*a*) is a photograph showing the skin surface of a continuously case sample containing 0.15% of Ni.
Figure 8:
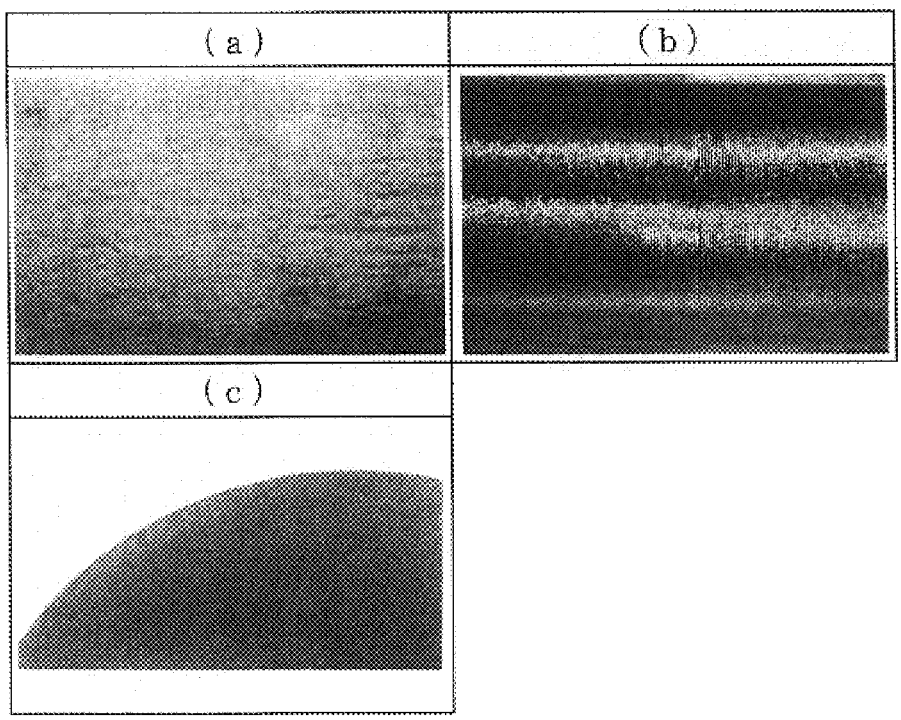
FIG. 8(*a*) is a photograph showing the skin surface of a continuously case sample containing 0.50% of Ni.

Ni: This element is added to improve the alloy in forgeability. When continuously casting a brass material containing Se, if the brass material also contains Ni, production of Se oxides is suppressed to obtain a cast product having a good skin surface and substantially no internal defect, resulting in enhancement of a cast product internal health property. This enables the products to be enhanced in yield and quality. FIG. 6(*a*) is a photograph showing the skin surface of a continuously cast sample containing 0.06% of Ni, FIG. 6(*b*) a photograph showing the surface of the sample cut off by a depth of 1.5 mm from the skin surface, FIG. 6(*c*) a photograph showing the partially enlarged portion of the cut surface shown in FIG. 6(*b*), and FIG. 6(*d*) a photograph showing the cross section of the continuously cast sample of FIG. 6(*a*). As shown in FIG. 6(*d*), there are Se oxides in the cross section, indicating that the internal health property of this sample is considerably bad. FIG. 7(*a*) is a photograph showing the skin surface of a continuously case sample containing 0.15% of Ni, FIG. 7(*b*) a photograph showing the surface of the sample cut off by a depth of 1.5 mm from the skin surface, and FIG. 7(*c*) a photograph showing the cross section of the continuously cast sample of FIG. 7(*a*). As shown in FIG. 7(*c*), Se oxides are not discernible, indicating that the internal health property of this sample is good. FIG. 8(*a*) is a photograph showing the skin surface of a continuously case sample containing 0.50% of Ni, FIG. 8(*b*) a photograph showing the surface of the sample cut off by a depth of 1.5 mm from the skin surface, and FIG. 8(*c*) is a photograph showing the cross section of the continuously cast sample of FIG. 8(*a*). As shown in FIG. 8(*c*), Se oxides are not discernible, indicating that the internal health property of this sample is good. Addition of Ni in excess of 0.50% results in reduction in the forgeability rather than to acquire corresponding effects. Therefore, the amount of Ni to be added for enhancing the forgeability is set at 0.10–0.50%. In addition, Ni is a very expensive material. Specifically, the cost thereof is about four times that of Cu and about six times that of Zn. Therefore, addition of Ni in an amount more than that required makes the cost of materials higher. For this reason, the amount is preferred to be not more than 0.30%.

Fe: Though this element, when added in a minute amount, effects fine division of crystal grains and enhances tensile strength, it forms hard and friable compounds with P and Sn. When such hard and friable compounds, $Fe_2P$ and $Fe_3Sn$, persist in the alloy, they bring adverse effects on the hot forgeability. The range of quantity of Fe, therefore, has been set at 0.05–0.3% in consideration of tensile strength, hot forgeability, and hot workability. Particularly, the range is preferred to be 0.05–0.20% in the case of the hot forging grade brass and 0.1–0.30% in the case of the machining grade brass.

P: This is added for obtaining tolerance for dezincification. Though the tolerance for dezincification is enhanced in proportion as the amount of this element to be added is increased, part of the added P forms hard and friable compounds with Cu and Fe and such hard and friable compounds, $Cu_3P$ and $Fe_2P$, persist in the alloy and bring adverse effects on hot forgeability and hot workability. The range of quantity of P for obtaining satisfactory tolerance for dezincification, hot forgeability and hot workability, therefore, has been set at 0.05–0.15%. Particularly, the range is preferred to be 0.05–0.10% in the case of the hot forging grade brass and likewise to be 0.05–0.10% in the case of the machining grade brass.

Now, the copper-based alloy contemplated by this invention will be divided into the machining grade brass bar and the forging grade brass bar and the relevant ranges of quantity of the components thereof will be described below.

The machining grade brass rod incorporates therein Cu and P in proper amounts with a view to securing tolerance for dezincification.

It has been customary to incorporate Pb in an amount of about 3% for the purpose of obtaining machinability. This amount of Pb must be repressed as much as possible in due consideration of the standard tolerance for liquation of Pb.

The Bi, an element having equal properties with Pb, is substituted for Pb with a view to obtaining better machinability and better state of surface finish than the conventional Pb-containing material. It has been found that the Bi brings slightly higher resistance to cutting than the Pb.

On the other hand, the incorporation of Bi+Se or Bi has successfully brought a satisfactory state of surface finish owing to the cooperation between the Bi which is an equal soft phase to Pb and the hard phase which is a compound of Se. When the Se content is unduly large, however, the excess increases the hard phase and degrades the machinability. Properly, therefore, the Se content is in the range of 0.03–0.2%. The amount of Bi that is required for obtaining the same machinability as the Pb content of about 2% has been found to be in the range of 1.5–2.0%. In addition, the amount of Ni for preventing Se compounds from being produced on the skin surface and in the interior of a cast product and enhancing the forgeability is preferred to be 0.10–0.50%.

For the hot forging grade brass bar, the Pb content is preferred to be as low as possible similarly to the machining grade brass bar.

For the purpose of obtaining the tolerance for dezincification, the Cu content is preferred to be larger than otherwise. For the purpose of obtaining the β phase in a proper amount in the region of the hot forging temperature, the Cu content must be decreased at a minor sacrifice of the tolerance for dezincification. To compensate for the decrease in the Cu content, Sn is added so much as to secure the needed tolerance for dezincification. Thus, Sn is added in an amount in the range of 0.5–1.5%. This addition results in inducing precipitation of a hard γ phase.

The conventional material acquires machinability of a certain degree owing to the precipitation of Pb+γ phase in the base phase, whereas the material of this invention acquires a fine state of finish on the machined surface besides the same degree of resistance to cutting as the conventional material in consequence of the effect of inducing precipitation of the Bi+Se+γ phase or the Bi+γ phase.

It has been heretofore held that the Pb content is preferred to be smaller than otherwise for the purpose of enabling the alloy to exhibit satisfactory hot forgeability. It follows that the Bi and Se contents are preferred to be as low as permissible. The Bi and the Se are nevertheless added for the purpose of imparting satisfactory machinability to the alloy. Furthermore, Ni is added in an amount of 0.10–0.50% in order to prevent Se oxides from being produced on the skin surface and in the interior of a cast product and enhancing the forgeability.

This invention further concerns a method for the production of a copper-based alloy which comprises compounding raw materials containing relevant components in predetermined amounts, dissolving the resultant mixture, then forming a cast billet by continuous casting of the dissolved mixture, extruding or rolling the cast billet, heat-treating the extruded or rolled billet, then drawing or rolling the resultant billet by way of plastic working, and air-cooling or furnace-cooling the drawn or rolled billet by way of heat treatment, thereby giving birth to copper-based alloy materials in the shape of bars or plates. To be more specific, the production of interest is accomplished by subjecting the cast billet, after being extruded or rolled, to a heat treatment performed at 475–600° C. for one–five hours, then performing a plastic working by drawing or rolling at a reduction of area in the range of 10–30% with a view to enhancing strength of material, further heating at a temperature in the range of 250–400° C. for one–five hours, and carrying out a heat treatment of air cooling or furnace cooling.

In the copper-based alloy according to this invention, the hot forging grade copper-based alloy is produced by performing the procedure mentioned above till after the dissolution step for compounding raw materials containing relevant components in predetermined amounts and dissolving the resultant mixture, continuously casting the dissolved mixture, thereby forming a cast billet, and extruding or rolling the cast billet. The conversion of the alloy into a forged product requires a heat treatment to follow the operation of forging.

For the manufacture of the copper alloy in a fused state after the addition of Bi and Se in this case, various methods are available. There can be cited a method which comprises adjusting components other than Se and Bi, throwing an intermediate copper alloy containing Se and Bi in proper amounts into a melt of the adjusted components other than Se and Bi, and manufacturing in a fused state a copper alloy of the components intended for brass, for example, a method which comprises heating and fusing a Se—Bi sinter together with components other than Se and Bi and manufacturing in a fused state a copper alloy of components intended for brass, for example, and a method which comprises throwing a Se—Bi sinter into a melt of components for a copper alloy.

This invention is also suitable for forming water-contact products, such as valves, joints, pipes, stopcocks and utensils for cold water supply and hot water supply, and for forming electrical mechanical products, such as gas utensils, washing machines and air conditioners by working such copper-based alloys mentioned above.

Besides, the members parts using copper-based alloys of this invention as materials therefor are widely applicable to water-contacting parts valves and stopcocks, specifically ball valves, hollow balls for use in ball valves, butterfly valves, gate valves, globe valves, check valves, hydrants, mounting brackets for hot water supply systems and hot water washing toilet seats, feed water pipes, connecting pipes and pipe joints, coolant pipes, parts for electric water heaters (casings, gas nozzles, cylinder parts, and burners), strainers, parts for water meters, parts for underwater sewage works, waste water plugs, elbow pipes, bellows, connecting flanges for toilet seats, spindles, joints, headers, branch plugs, hose nipples, attachments for stopcocks, water stop plugs, utensils for feed and discharge water plugs, fittings for sanitary earthware, connectors for shower hoses, gas utensils, building materials, such as doors and knobs, household electric parts, adapters for sheath headers, automobile cooler parts, fishing parts, part for microscopes, parts for water supply meters, parts for measuring instruments, parts for railroad pantographs, and others. They are also applicable extensively to utensils for toilets, utensils for kitchens, utensils for bathrooms, utensils for washrooms, utensils for articles of furniture, utensils for living rooms, parts for sprinklers, parts for doors, parts for gates, parts for bending machines, parts for washing machines, parts for air conditioners, parts for gas welders, parts for heat exchangers, parts for solar heat water warmers, metal dies and parts therefor, bearings, toothed wheels, parts for construction machines, parts for railroad vehicles, parts for transportation machines, crude materials, intermediate products, finished products, and assembled products.

Now, one working example of this invention will be explained below together with the results of tests performed on copper-based alloys according to this invention.

① Machinability

The term "machinability" as used herein is meant to embrace evaluation of resistance to cutting, state of surface finish and chips. Various materials obtained in accordance with this invention were tested for machinability in comparison with conventional materials. They were found by this test to excel in machinability. Specifically, test pieces of a given material measured for resistance to cutting during the course of working with the aid of a strain gauge, with the conditions for machining set as shown in Table 2. The chips occurring during the cutting were collected and visually observed to determine the shape.

TABLE 2

| Conditions for machining | | | |
|---|---|---|---|
| Number of revolutions (rpm) | Feed rate (0.1 mm/rev) | Depth of cut (mm) | Cutting oil |
| 850 | 0.16 | 1.0 | None |

The results of this test for machinability were as shown in Table 3.

TABLE 3

| Machinability index of material tested | |
|---|---|
| Name of material | Machinability index |
| C3604BD (conventional product) | 100 |
| Material for comparison (containing Pb) | 92 |
| Material of this invention | 89 |

Machinability index = {[Resistance of C3604BD to cutting]/[Resistance of given material to cutting]} × 100

Figure 3:
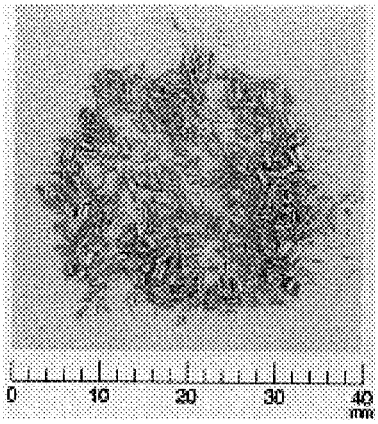
FIG. 3 is a photograph illustrating the state of chips finely shredded from the material of this invention.
Figure 4:
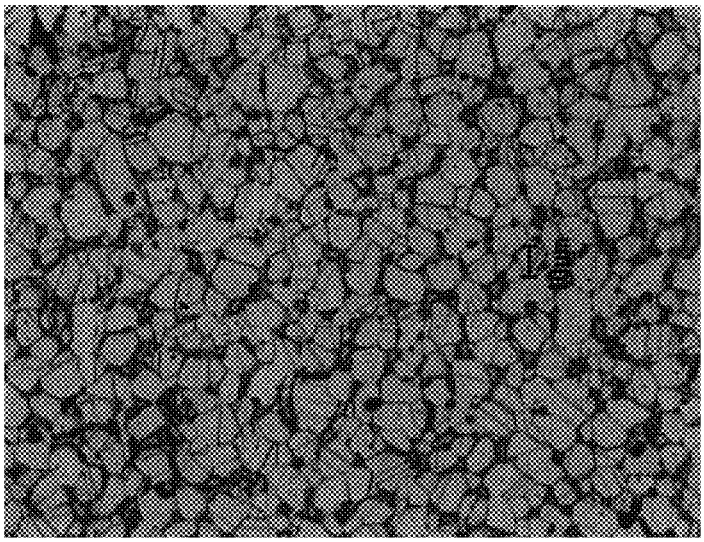
FIG. 4 is a photomicrograph (400 magnifications) of a copper-based alloy involved in this invention.
Figure 5:
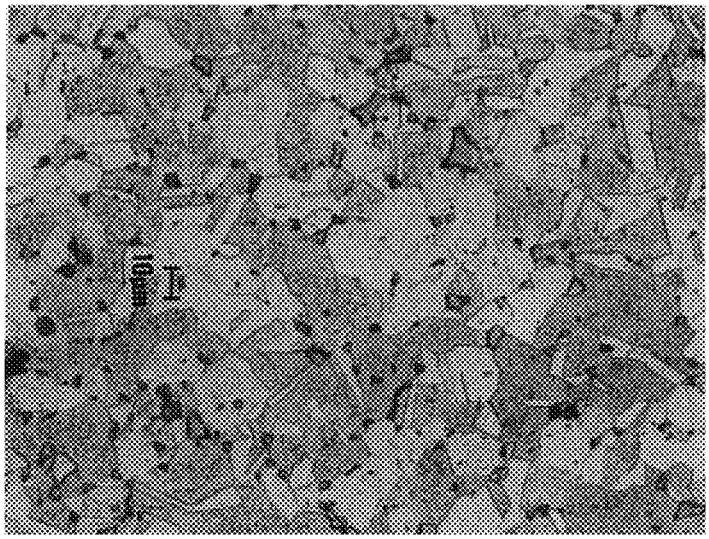
FIG. 5 is a photomicrograph (400 magnifications) of another copper-based alloy involved in this invention.

The chips 1 from the material of this invention were finely cut as shown in FIG. 3. The material was found to have machinability index on a par with the other material, indicating that it was excellent in machinability.

② Tolerance for Dezincification

The material of this invention and the material for comparison were rated for tolerance for dezincification by a test (ISO6509-1981). The testing method used herein comprised subjecting a given sample to heating corrosion in an aqueous 12.7 g/liter cupric chloride dihydrate solution at 75° C. for 24 hours and thereafter measuring the depth of a dezincified layer. The results of this test were as shown in Table 4.

TABLE 4

Corrosion by dezincification (ISO)

| | Depth of corrosion (average) (μm) | Depth of corrosion (maximum) (μm) | Type of Dezincified layer |
|---|---|---|---|
| Material of this invention | 0 | 0 | None |
| Material for comparison (proofed against dezincification) | 10 | 15 | Local |
| C33771 | 1350 | 1450 | Layer |

The material of this invention excelled C3771 (forging grade brass) and was equal to or more than the material for comparison (material proofed against zincification) in tolerance for dezincification. Thus, the material of this invention excelled in tolerance for dezincification.

③ Resistance to Stress-corrosion Cracking

The material of this invention and the material for comparison were tested for resistance to stress-corrosion cracking and rated for the property. The testing method used herein comprised applying stress for 24 hours to a given test piece in an atmosphere of ammonia of not less than 11.8% in accordance with the method A for testing the aging crack specified in ASTMG39 and thereafter rating the crack sustained on the surface of the test piece. The results of this test were as shown in Table 5.

TABLE 5

Resistance to stress-corrosion cracking

| | Threshold stress for resistance to stress-corrosion cracking |
|---|---|
| Material of this invention (Brass proofed against leadless dezincification) | 280 N/mm$^2$ |
| Material for comparison (Proofed against dezincifcation) | 120 N/mm$^2$ |

Thus, the threshold stress of the material of this invention (brass proofed against leadless dezincification) in the corrosion-resistance cracking was about 2.3 times that of the material for comparison (brass proofed against dezincification).

Now, the evaluation of the hot forging grade brass bar according to this invention will be described below.

Figure 9:
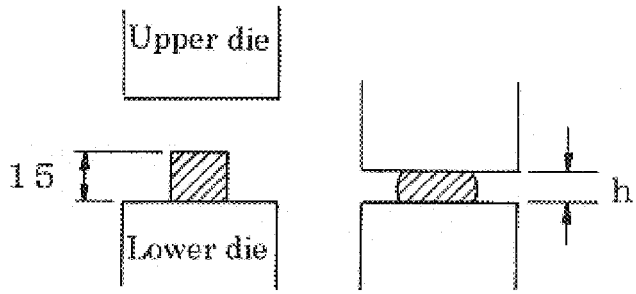
FIG. 9 is an explanatory diagram illustrating a method for performing an upset test on a hot forging grade brass bar.

Evaluation of a sample 15 mm in diameter and 15 mm in length was conducted by an upset test wherein the sample heated to a predetermined temperature was depressed with a press to a predetermined upset ratio. The upset ratio used herein was as shown in the following equation in which it stands for the height of the sample that has been depressed as shown in FIG. 9.

$$\text{Upset ratio } (\%)=(15-h)/15\times 100$$

Figure 10:
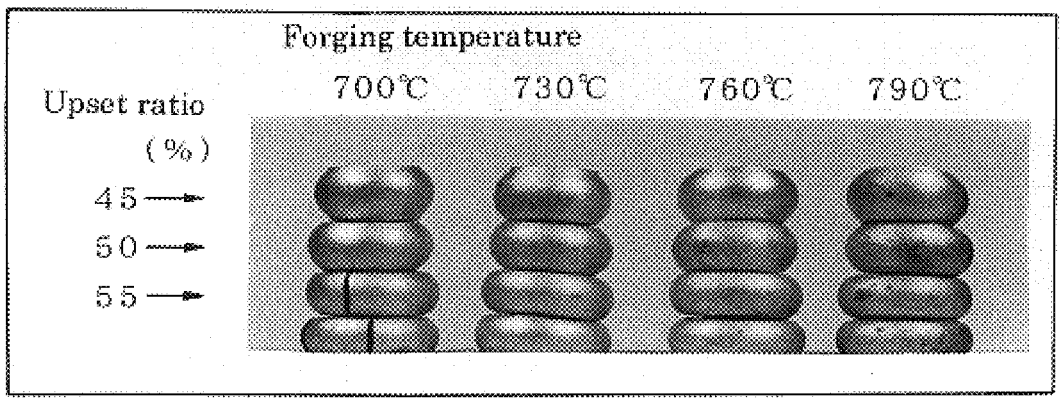
FIG. 10 is a photograph illustrating the results of the test of FIG. 9 performed on a comparative material.

A given material was rated based on the presence or absence of a crack generated on the surface of a given sample after the depression. The results obtained of the hot forging grade dezincificationproof brass bar of the material for comparison, were as shown in FIG. 10 and Table 6.

TABLE 6

Brass bar of material for comparison

| | Forging temperature (° C.) | | | |
|---|---|---|---|---|
| Upset ratio (%) | 700 | 730 | 760 | 790 |
| 45 | ○ | ○ | ○ | ○ |
| 50 | ○ | ○ | ○ | ○ |
| 55 | X | ○ | ○ | ○ |

Figure 11:
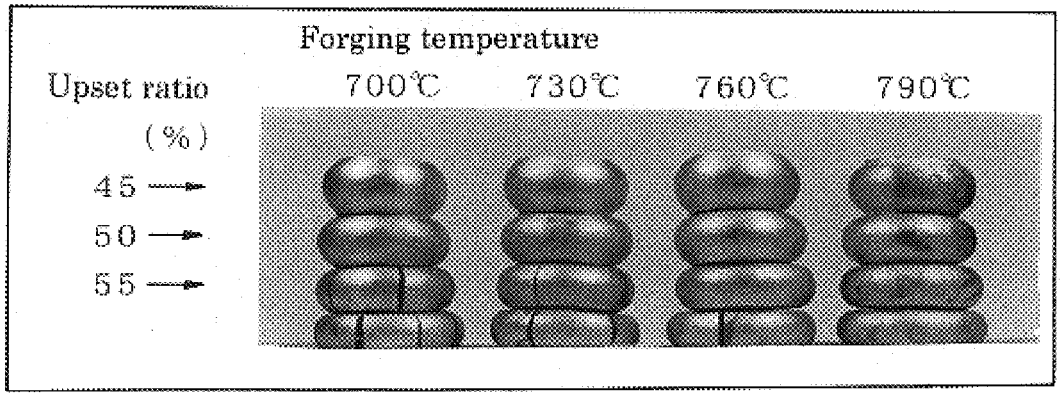
FIG. 11 is a photograph illustrating the results of the test of FIG. 9 performed on a material of this invention.

The results obtained of the hot forging grade dezincificationproof brass bar of the material of this invention were as shown in FIG. 11 and Table 7.

TABLE 7

Brass bar of the material of this invention

| | Forging temperature (° C.) | | | |
|---|---|---|---|---|
| Upset ratio (%) | 700 | 730 | 760 | 790 |
| 45 | ○ | ○ | ○ | ○ |
| 50 | ○ | ○ | ○ | ○ |
| 55 | X | X | ○ | ○ |

By comparing the two set of data given above, it is clear that although the hot forgeability of the material of this invention was slightly inferior to the material for comparison on the lower temperature side in the range of 700–730° C., the material of this invention could be formed at a proper forging temperature in the range of 740–800° C. with nearly the same efficiency as the material for comparison.

Figure 12:
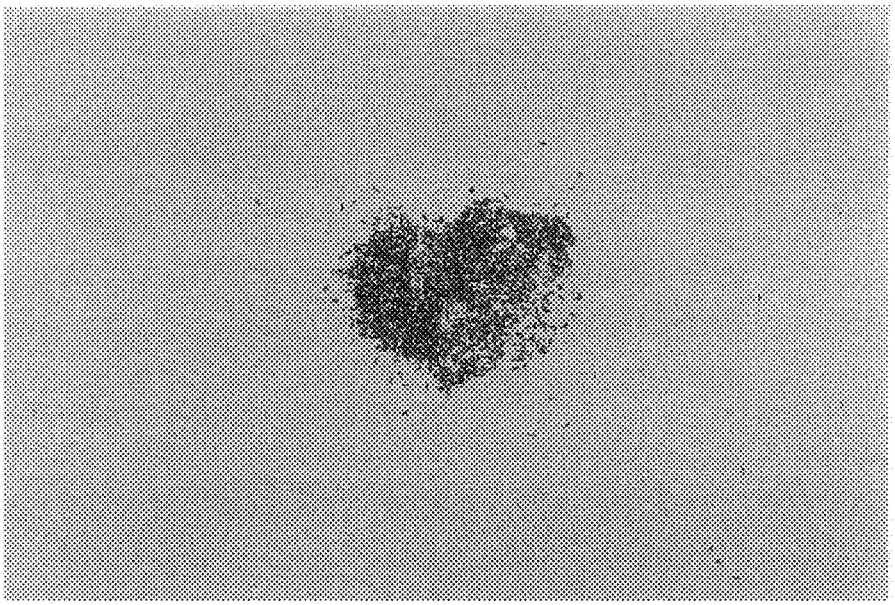
FIG. 12 is a photograph illustrating the state of chips from a conventional hot forging grade brass bar.
Figure 13:
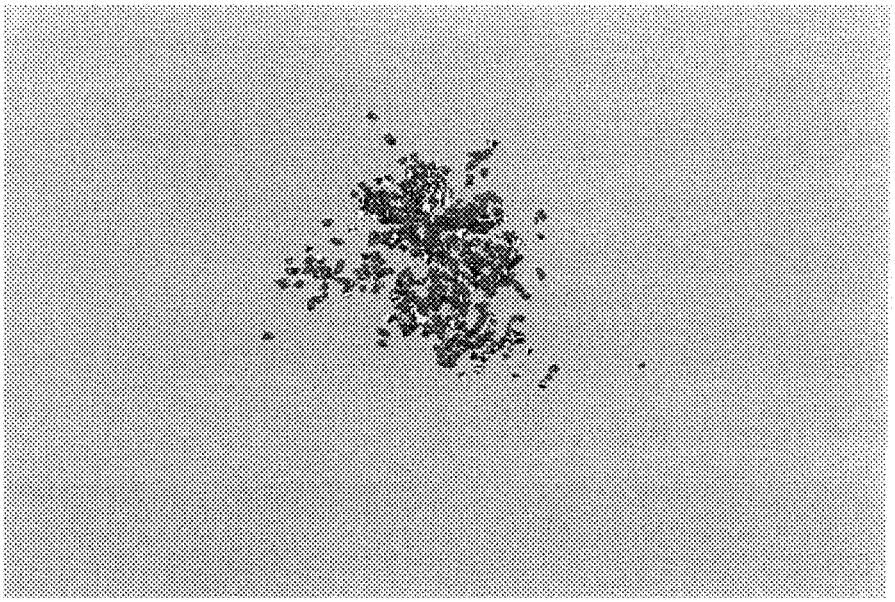
FIG. 13 is a photograph illustrating the state of chips from a hot forging grade brass bar of this invention.

Then, the hot forging grade brass bar was rated for machinability from state of chips under the conditions for machining shown in Table 2. The chips from the hot forging grade dezincificationproof brass bar of the conventional material (JIS C3771) were as shown in FIG. 12. When the state of the chips shown in FIG. 12 and the state of the chips shown in FIG. 13 from the hot forging grade dezincificationproof brass bar of the material of this invention are compared, it is noted that the two materials showed satisfactory machinability as evinced by the fact that the chips and fresh from the operation of cutting were both finely divided.

Now, evaluation of a round bar sample measuring 12 mm in diameter and 42.9 mm in length by the test for exudation of lead will be described below. A given sample was dry-polished with sand paper No. 400 and coated on one end face with an insulating coating material for protection against crevice corrosion. The exposure surface area was 17.29 cm$^2$ per piece. The components of alloys involved herein were as shown in Table 8.

TABLE 8

| | Component (%) | | | | | | |
|---|---|---|---|---|---|---|---|
| Material | Cu | Pb | Sn | P | Bi | Se | Zn |
| A of this invention | 62.2 | 0.19 | 0.64 | 0.08 | 2.2 | 0.05 | Balance |
| B of this invention | 62.6 | 0.01 | 0.05 | 0.09 | 1.7 | 0.04 | Balance |
| Material for comparison | 62.5 | 2.2 | 0.11 | 0.09 | — | — | Balance |

The test for exudation was performed by the method for testing a utensil for water supply for the property of exudation specified in JIS (Japanese Industrial Standard) S3200-7: 1997. The test was indicated in 7.2 Test of Part and Material and the method of operation was indicated in 7.1.3 Water Supply Utensil installed in piping (intended for passing heated water). The adjusted exudates (for conditioning and exudation) were tested exclusively for pH and the exudates obtained during the initial adjustment and during the operation of exudation were tested for pH, hardness, alkalinity, and residual chlorine. The heating was carried out at 90±2° C. As a blank, a sample solution treated in the same manner as during the operation of exudation was prepared. The exudate (sample solution) during the operation of exudation was 100 ml in volume. After the operation of exudation and while the test sample and the container were cleaned in preparation for analysis, the exudate was diluted to 250 ml and adjusted (in acidity with an aqueous 0.1 mol/liter nitric acid solution). The sample solution was analyzed by the inductively coupled plasma (ICP) emission spectroscopic method.

In accordance with the standard concerning the structure and the material of a water supply device conforming to the Law concerning Water Works, the criterion for the evaluation of the property of lead exudation is set at 0.05 mg/liter as the maximum. This numerical value was adopted as the criterion of evaluation herein.

TABLE 9

| Material | Amount of exuded lead (mg/liter) | Rating |
|---|---|---|
| A of this invention | 0.02 | ○ |
| B of this invention | Not more than 0.005 | ○ |
| Conventional material (C3771) | 0.2 | X |

While the conventional material surpassed the criterion for evaluation because it contained lead in an amount required for obtaining machinability, the materials A and B of this invention passed the test by showing magnitudes falling below the criterion for evaluation. Though the lead content is inherently preferred to be as small as permissible, the cost of production of alloy increases in accordance as the lead content decreases. The lead content, therefore, has been specified to be not more than 0.2% in consideration of the standard of evaluation of the tolerance for the exudation of lead.

Now, a concrete example of the evaluation of the dispersion of the soft phase and the hard phase is shown in Table 10.

TABLE 10

| | Phase | | | |
|---|---|---|---|---|
| | Soft phase system Pb system | | Soft + hard phase Bi + Se and | Hard phase γ phase |
| Item of Evaluation | (C3604) | Material for comparison | Bi + Se + γ phase Material of this invention | alone Material for comparison |
| Index of resistance to cutting | 100 | 92 | 89 | 50 |
| Index of state of surface finish | 100 | 75 | 111 | 118 |

It is clear from the test results that the dispersion of the soft phase plus the hard phase resulted in obtaining proper resistance to cutting and proper state of surface finish.

The copper-based alloy involved in this invention, as described above, was mainly an example of brass. When bronze fits the technical concept of this invention, this invention can be applied thereto.

It is clear from the description given thus far that this invention is capable of not only producing a copper-based alloy satisfying the measure to preclude the environment pollution by lead liquation but also obtaining a novel copper-based alloy excelling in machinability, tolerance for dezincification, and hot forgeability.

What is claimed is:

1. Brass consisting of Cu, Sn, Bi, Se, Fe, Ni and P in weight ratios respectively of 59.0–62.0%, 0.5–1.5%, 1.0–2.0%, 0.03–0.20%, 0.05–0.20%, 0.10–0.50% and 0.05–0.10% plus the balance of Zn and unavoidable impurities and exhibiting excellent hot forgeability.

2. Brass consisting of Cu, Sn, Bi, Se, Fe, Ni and P in weight ratios respectively of 61.0–63.0%, 0.3–0.7%, 1.5–2.5%, 0.03–0.20%, 0.10–0.30%, 0.10–0.50%, and 0.05–0.10% plus the balance of Zn and unavoidable impurities and exhibiting excellent machinability.

* * * * *